US009599294B2

(12) United States Patent
Rosenauer et al.

(10) Patent No.: US 9,599,294 B2
(45) Date of Patent: Mar. 21, 2017

(54) LED LIGHTING DEVICE WITH MINT, AMBER AND YELLOW COLORED LIGHT-EMITTING DIODES

(71) Applicant: OSRAM GmbH, Munich (DE)

(72) Inventors: Michael Rosenauer, Regensburg (DE); Bernhard Rieder, Regensburg (DE); Moritz Engl, Shenzhen (CN)

(73) Assignee: OSRAM GmbH (DE)

( * ) Notice: Subject to any disclaimer, the term of this patent is extended or adjusted under 35 U.S.C. 154(b) by 0 days.

(21) Appl. No.: 14/389,774

(22) PCT Filed: Mar. 26, 2013

(86) PCT No.: PCT/EP2013/056414
§ 371 (c)(1),
(2) Date: Oct. 1, 2014

(87) PCT Pub. No.: WO2013/149890
PCT Pub. Date: Oct. 10, 2013

(65) Prior Publication Data

US 2015/0055338 A1 Feb. 26, 2015

(30) Foreign Application Priority Data

Apr. 2, 2012 (DE) ..... 10 2012 205 381

(51) Int. Cl.
*F21V 9/00* (2015.01)
*F21K 99/00* (2016.01)
(Continued)

(52) U.S. Cl.
CPC ..... *F21K 99/00* (2013.01); *F21K 9/232* (2016.08); *F21S 10/02* (2013.01); *H05B 33/08* (2013.01); *H05B 33/0803* (2013.01); *H05B 33/0857* (2013.01); *F21Y 2101/00* (2013.01); *F21Y 2105/10* (2016.08); *F21Y 2105/12* (2016.08);
(Continued)

(58) Field of Classification Search
None
See application file for complete search history.

(56) References Cited

U.S. PATENT DOCUMENTS 6,411,046 B1 6/2002 Muthu
7,744,242 B2 6/2010 Kraemer
(Continued)

FOREIGN PATENT DOCUMENTS

DE 102005022832 A1 11/2006
DE 60122005 T2 3/2007
(Continued)

OTHER PUBLICATIONS

Brilliant Mix—Professional White for General Lighting, Jan. 2011; pp. 1-14.
(Continued)

*Primary Examiner* — Peggy Neils
*Assistant Examiner* — Alexander Garlen
(74) *Attorney, Agent, or Firm* — Hayes Soloway PC

(57) ABSTRACT

Various embodiments may relate to an LED lighting device, including at least one mint-colored light-emitting diode, at least one amber-colored light-emitting diode and at least one yellow light-emitting diode and/or blue light-emitting diode.

15 Claims, 2 Drawing Sheets

(51) Int. Cl.
*F21S 10/02* (2006.01)
*H05B 33/08* (2006.01)
*F21Y 101/00* (2016.01)

(52) U.S. Cl.
CPC ..... *F21Y 2113/13* (2016.08); *F21Y 2115/10* (2016.08)

(56) References Cited

U.S. PATENT DOCUMENTS

| | | | | |
|---|---|---|---|---|
| 8,125,137 | B2 | 2/2012 | Medendorp, Jr. et al. | |
| 2002/0048177 | A1 | 4/2002 | Rahm et al. | |
| 2003/0133292 | A1* | 7/2003 | Mueller | A45D 42/10 362/231 |
| 2004/0218387 | A1 | 11/2004 | Gerlach | |
| 2005/0127381 | A1 | 6/2005 | Vitta et al. | |
| 2008/0013312 | A1 | 1/2008 | Wu et al. | |
| 2009/0050912 | A1 | 2/2009 | Chu et al. | |
| 2010/0237766 | A1 | 9/2010 | Baumgartner et al. | |
| 2011/0068698 | A1 | 3/2011 | Swoboda et al. | |
| 2011/0068702 | A1* | 3/2011 | van de Ven | H05B 33/0854 315/186 |
| 2012/0001555 | A1 | 1/2012 | Tu et al. | |
| 2012/0069556 | A1* | 3/2012 | Bertram | F21V 29/74 362/217.14 |
| 2012/0120644 | A1* | 5/2012 | Rieger | F21S 4/00 362/219 |
| 2012/0127743 | A1* | 5/2012 | Hoetzl | F21V 19/0055 362/396 |
| 2012/0274217 | A1* | 11/2012 | Harrison | F21K 9/54 315/151 |
| 2012/0305953 | A1 | 12/2012 | Bertram et al. | |
| 2013/0140988 | A1* | 6/2013 | Maxik | F21K 9/13 315/113 |

FOREIGN PATENT DOCUMENTS

| | | | |
|---|---|---|---|
| DE | 102008021572 | A1 | 12/2008 |
| DE | 102007043355 | A1 | 3/2009 |
| DE | 102007058700 | A1 | 3/2009 |
| DE | 102009047789 | A1 | 3/2011 |
| EP | 1348318 | B1 | 8/2006 |
| WO | 2011044931 | A1 | 4/2011 |
| WO | 2013028449 | A1 | 2/2013 |

OTHER PUBLICATIONS

International Search Report dated May 23, 2013.
Office Action dated Mar. 20, 2013 issued in the parallel German application.

* cited by examiner

LED LIGHTING DEVICE WITH MINT, AMBER AND YELLOW COLORED LIGHT-EMITTING DIODES

RELATED APPLICATIONS

The present application is a national stage entry according to 35 U.S.C. §371 of PCT application No.: PCT/EP2013/056414 filed on Mar. 26, 2013, which claims priority from German application No.: 10 2012 205 381.6 filed on Apr. 2, 2012, and is incorporated herein by reference in its entirety.

TECHNICAL FIELD

Various embodiments generally relate to an LED lighting device, including at least one mint-colored light-emitting diode and at least one amber-colored light-emitting diode ("brilliant mix"). Various embodiments may be used advantageously in particular for retrofit lamps, in particular incandescent lamp retrofit lamps, in particular for decorative purposes.

BACKGROUND

LED modules in which InGaN chips and InGaAlP chips are combined are known. One exemplary application is a combination of phosphor-converted InGaN chips that emit mint-colored light (blue LED chip with (yellow-)green phosphor) together with InGaAlP chips that emit amber-colored light, for generating warm-white mixed light with high color rendering. Such LED modules are also known as "brilliant mix", e.g. from a company publication from Osram Opto Semiconductors: "Brilliant Mix—Professional White for General Lighting", January 2011. The "brilliant mix" is also described for example in DE 10 2009 047 789 A1 or WO 2011/044931 A1.

Between room temperature (25° C.) and a normal operating temperature (junction temperature) of approximately 80° C. to 100° C., a light power of the amber-colored InGaAlP chip decreases by typically 30% to 40%, while that of an InGaN chip decreases only by typically 5% to 20%. Overall, the mixed light may thus undergo a color change which is clearly perceptible to an observer and which may typically encompass up to 20 MacAdam steps. If, specifically, a "brilliant mix" LED module is set such that the color locus is situated on the Planckian locus at normal operating temperature, then the color locus shifts distinctly into the red in a cool state, e.g. when the LED module is switched on. This shift of the color locus ("color shift") is undesirable, however.

EP 1 348 318 B1 discloses as a solution, in order to reduce the temperature-dependent shift of the cumulative color locus, an external regulation of the electrical operating currents through the LED chips, whereby the brightness thereof is regulated. In that case it is necessary either to measure the temperature and/or the color locus of the LED chips and then to correspondingly readjust the ratio of the operating currents through the InGaN and InGaAlP chips. This regulation is comparatively complex and expensive.

SUMMARY

Various embodiments provide a lighting device including light-emitting diodes in the "brilliant mix" which has a temperature-dependent shift of its cumulative color locus that is adapted to a behavior of a conventional lamp in an improved way.

Various embodiments relate to an LED lighting device, including at least one mint-colored light-emitting diode, at least one amber-colored light-emitting diode and at least one yellow and/or blue light-emitting diode.

A mixed light generated by these light-emitting diodes has the advantage that the mint-colored light-emitting diode(s) and the amber-colored light-emitting diode(s) enable a high color rendering index (CRI), while the yellow light-emitting diode(s) and/or the blue light-emitting diode(s) enable(s) at least partial compensation of a color change at low operating temperatures. This makes use of the fact that a brightness of, for example, yellow light-emitting diodes decreases particularly rapidly as the operating temperature rises. By means of the at least one yellow and/or blue light-emitting diode, therefore, a cumulative color locus of the mixed light emitted by the LED lighting device at low operating temperatures (e.g. after switch-on), when the mint-colored and the amber-colored light-emitting diodes are not yet at their normal color locus, may be shifted in a targeted manner, in particular in the direction of a Planckian locus and/or toward lower color temperatures. As a result in turn it is possible to adapt a color impression at low operating temperatures, e.g. to a color impression of an incandescent lamp or other conventional lamp to be replaced. As the operating temperatures rise, the color loci of the mint-colored and amber-colored light-emitting diodes move in the direction of their standard values, and the brightness of the yellow and/or blue light-emitting diode(s) decreases to an extent such that the mixed light emitted by the LED lighting device is only slightly or even practically no longer influenced thereby. The at least one yellow and/or blue light-emitting diode may therefore serve as a passive additional light source (not to be actively controlled) for low operating temperatures.

A further advantage is that, as before, a single-channel driver may be used for feeding the light-emitting diodes.

A mint-colored light-emitting diode is understood to mean a light-emitting diode which emits mint-colored light. Mint-colored light may correspond, in particular, to the so-called "EQ-white" of the "brilliant mix". Mint-colored light may lie in particular in a region of the CIE diagram which extends rectilinearly between the color coordinates {cx=0.325+/−0.05; cy=0.360+/−0.025} and {cx=0.405+/−0.05; cy=0.515+/−0.025}, or as described in DE 10 2009 047 789 A1 or WO 2011/044931 A1.

A mint-colored light-emitting diode may include, in particular, an LED chip which emits blue light and which is covered with a green phosphor that converts the blue light at least partly into green light and generates a white light shifted into the green color range. The blue LED chip may be, in particular, an InGaN chip.

One possible mint-colored light-emitting diode is offered, for example, by Osram Opto Semiconductors under the designation "OSLON SSL LUW CQDP (EQW)". In particular, the color locus groups M8, M9 and MA to MW thereof may be used.

An amber-colored light-emitting diode is understood to mean a light-emitting diode which emits amber-colored light. Amber-colored light may correspond in particular to a wavelength range of between 610 nm and 620 nm, in particular between 612 nm and 620 nm, in particular between 612 nm and 617 nm. Such an amber-colored light-emitting diode is sometimes also designated as a red or red-orange-colored light-emitting diode.

One possible amber-colored light-emitting diode is offered, for example, by Osram Opto Semiconductors under the designation "OSLON SSL LA CPDP", inter alia in a plurality of wavelength groups (groups 2 to 4).

A yellow light-emitting diode is understood to mean a light-emitting diode which emits yellow light. Yellow light may correspond in particular to a wavelength range of between 580 nm and 600 nm. This wavelength range is sometimes also designated as "orange" or amber-colored or "amber".

One possible yellow light-emitting diode is offered, for example, by Osram Opto Semiconductors under the designation "OSLON SSL LY CPDP", inter alia in a plurality of wavelength groups (groups 3 to 6).

A blue light-emitting diode is understood to mean a light-emitting diode which emits blue light. Blue light may correspond in particular to a wavelength range of between 460 nm and 480 nm.

At least some of the light-emitting diodes may be present as packaged ("single package") light-emitting diodes with an LED chip contained therein. Alternatively or additionally, at least some of the light-emitting diodes may be present as unpackaged LED chips, e.g. as light sources of a chip module ("chip-on-board" module). In a configuration as a "chip-on-board" module, any suitable chip-on-board technology or bare die mounting technology may be used. A "chip-on-board" module has the advantage that it includes a concentrated light source (light engine) or group of individual light sources and light mixing is thus simplified.

An LED chip of a light-emitting diode may be covered with a light-scattering material. In this regard, the light-emitting diode may include an LED chip (in particular thin-film chip) covered with a lamina composed of or including phosphor. This LED chip covered in this way may in turn be potted with a potting compound containing light-scattering material. Alternatively, the LED chip (in particular "bare die" chip) may be potted with a potting compound containing phosphor and light-scattering material.

The light-emitting diodes may be applied on a printed circuit board (e.g. a metal-core circuit board, a ceramic circuit board or an FR4 circuit board) or a submount (e.g. a common ceramic substrate).

By way of example, the (cumulative) color locus of a cold "brilliant mix" arrangement having the color coordinates {cx=0.5; cy=0.4} in the CIE color space from the Planckian locus is at a distance of approximately 5 MacAdam ellipses from the Planckian locus along the Judd line in the direction of 2100 K {cx=0.515; cy=0.415}. A yellow light-emitting diode having a peak wavelength of up to 586 nm corresponding to {cx=0.55; cy=0.450} brings about a shift in the (cumulative) color locus in the direction of the Planckian locus.

In one configuration, the LED lighting device includes one or a plurality of sets including in each case exactly one light-emitting diode, that is to say in each case exactly one mint-colored light-emitting diode, exactly one amber-colored light-emitting diode and exactly one yellow or blue light-emitting diode. A minimum number of light-emitting diodes is provided as a result. A setting of the color locus may be carried out, for example, by means of an, if appropriate fixedly chosen, adaptation of the respective operating currents. This configuration is particularly suitable for the replacement of a traditional incandescent bulb having a power of approximately 25 watts (corresponding to approximately 200 to 250 lumens). A (cumulative) color locus at CCT=2550 K is achieved here in the normal operating state. This configuration additionally has a very good color rendering owing to the use of the "brilliant mix".

In another configuration, the LED lighting device includes a plurality of yellow light-emitting diodes, the number of which corresponds at least approximately to a number of the mint-colored and amber-colored light-emitting diodes. This enables the cumulative color locus of the mixed light of the LED lighting device to be shifted even exactly to the Planckian locus (e.g. at 2100 K) even at low operating temperatures (approximately 0° C. to approximately 25° C.) in a simple manner, specifically even without the dimming of individual light-emitting diodes.

In yet another configuration, the LED lighting device includes a plurality of yellow light-emitting diodes, the number of which corresponds at least approximately to one quarter of the light-emitting diodes. This constitutes a good compromise between an improved temperature-dependent setting of the color locus, an efficiency and a total number of light-emitting diodes to be used.

In one configuration thereof, the number of mint-colored light-emitting diodes and the number of amber-colored light-emitting diodes at least approximately correspond to one another and of them at least approximately every sixth mint-colored light-emitting diode and every third amber-colored light-emitting diode is replaced by a yellow light-emitting diode. This makes it possible to achieve a particularly effective approach to a Planckian locus both at low and at high (normal) operating temperatures.

In one particularly preferred development thereof, a set of light-emitting diodes includes five mint-colored light-emitting diodes, four amber-colored light-emitting diodes and three yellow or blue light-emitting diodes. The set may also be present multiply. This development has the advantage that such a set of twelve light-emitting diodes may readily be accommodated on a heat sink of an incandescent lamp retrofit lamp and may approximate a desired temperature dependence of a color locus to a conventional incandescent bulb very well in conjunction with a high CRI.

By way of example, a distance from the Planckian locus at 2250 K may be just one MacAdam ellipse, and this is in conjunction with a reduction in an overall efficiency of only 13% in the hot state.

In one configuration, furthermore, the LED lighting device is dimmable by reduction of an operating current of the mint-colored light-emitting diodes and of the amber-colored light-emitting diodes. By way of example, the color locus of conventional incandescent lamps shifts from white-yellow (approximately 2700 K) at 100% luminous flux to yellow-orange (less than 2200 K) at 10% luminous flux. In order to achieve this in LED lamps as well, in this case the mint-colored light-emitting diodes or amber-colored light-emitting diodes are dimmed, while the yellow light-emitting diode(s) is or are operated with unchanged current. This may lead, for example, to a shift in the color locus from 2550 K to 2150 K.

The light-emitting diodes may be operated with constant current or in pulse width operation.

In one configuration, moreover, the LED lighting device includes a plurality of light-emitting diodes belonging to different wavelength groups. A particularly flexibly configurable and soft color locus shift is made possible as a result. Moreover, a higher production yield may be achieved in this way.

Wavelength groups may be understood to mean, in particular, groups (often also called "bins") of light-emitting diodes which are sorted during or after their production and which correspond to different subranges of a usable wavelength range. By way of example, in the case of yellow light-emitting diodes, these may be subgroups corresponding to a respective (in particular non-overlapping) segment of the usable wavelength range between 580 nm and 600 nm. In the case of the mint-colored light-emitting diodes, it is possible to use, for example, light-emitting diodes from the bins of groups M8 to MW, in particular MA to MW, such as are described e.g. in "Brilliant Mix—Professional White for General Lighting" from Osram Opto Semiconductors, dated January 2011.

In a further configuration, which is advantageous for the particularly effective compensation of temperature-dictated color changes during a run-up of the lighting device, the LED lighting device includes one or a plurality of sets including in each case one mint-colored light-emitting diode, one amber-colored light-emitting diode and a plurality of yellow light-emitting diodes (in particular including a respective InGaAlP chip), wherein the yellow light-emitting diodes belong to different wavelength groups.

In this regard, it is possible to use, for example, two yellow light-emitting diodes including InGaAlP chips from different dominant wavelength groups, for example where $\lambda$=583 (e.g. Osram OSLON SSL LY CPDP from group 3) and where $\lambda$=590 nm (e.g. Osram OSLON SSL LY CPDP from group 5). This makes use of the effect that the dominant wavelength of InGaAlP chips shifts on average by 4 nm to 5 nm upon the heating of the lighting device from room temperature (T=25° C.) to normal operating temperature (e.g. T=85° C.). A particularly suitable dominant wavelength, in order to enable a shift between a color temperature CCT of 2700 K and 2100 K virtually on the Planckian locus for the "brilliant mix", has a magnitude of $\lambda$=approximately 590 nm.

In one possible operating mode, the LED lighting device may be operated at room temperature with the mint-colored light-emitting diode, the amber-colored light-emitting diode and the yellow light-emitting diode with the highest dominant wavelength (here: of group 5). A straight line in the color space having the end points of, on the one hand, the mint-colored light-emitting diode and, on the other hand, the amber-colored light-emitting diode at 2700 K and additionally with the light of the yellow light-emitting diode of group 5 virtually lies on the Planckian locus. If the LED lighting device then heats up, the dominant wavelength of the yellow light-emitting diode of group 5 shifts in the direction of $\lambda$=595 nm. In order to compensate for this wavelength shift, the yellow light-emitting diode with the next lower dominant wavelength (here: of group 3) may then be switched in, in a temperature-dependent manner. This may be carried out e.g. by means of a temperature-dependent increase in an operating current through the yellow light-emitting diode of group 3. The latter starts at 583 nm at room temperature and shifts to 587 nm up to the normal operating temperature. If both yellow light-emitting diodes are operated with the same current at normal operating temperature, firstly the ideal color locus of approximately 590 nm for yellow is obtainable again by means of the averaging of the wavelengths, and secondly it is possible to compensate for the dip in brightness on account of the temperature increase.

Therefore, in one configuration, moreover, at a relatively low temperature, only the yellow light-emitting diode from the wavelength group with the highest dominant wavelength is operated and, as the temperature increases, the yellow light-emitting diodes from the wavelength groups with the lower dominant wavelengths are progressively switched in (in the case of only two yellow light-emitting diodes, therefore, only the one light-emitting diode with the lower dominant wavelength, otherwise progressively the light-emitting diodes with the plurality of lower dominant wavelengths).

In one configuration that may be implemented particularly simply and inexpensively, the at least one mint-colored light-emitting diode includes an InGaN chip, the at least one amber-colored light-emitting diode includes an InGaAlP chip, and the at least one yellow light-emitting diode includes an InGaAlP chip.

In an alternative configuration, all light-emitting diodes include LED chips of the same basic type, in particular InGaN chips. This enables particularly temperature-stable operation since all the LED chips have the same temperature dependence and, consequently, an electronic and/or optical compensation is not necessary. In this case, in particular, all the light-emitting diodes may be converting light-emitting diodes, that is to say include phosphor, e.g. blue-amber-colored or blue-yellow phosphor.

In another configuration, the LED lighting device includes at least one blue light-emitting diode and is designed to switch off the at least one blue light-emitting diode upon a temperature threshold value being reached, wherein the temperature threshold value lies below a typical operating temperature of the at least one blue light-emitting diode. The switching off may be achieved by means of a bypass circuit, for example. This LED lighting device enables the advantage that in the normal operating state only the customary "brilliant mix" need be in operation and low-current operation of the blue (and/or yellow) light-emitting diode(s) may be avoided.

In yet another configuration, the LED lighting device is a retrofit lamp, in particular an incandescent lamp or halogen lamp retrofit lamp. In particular, the retrofit lamp may be used for decorative purposes, e.g. in chandeliers.

However, the LED lighting device is not restricted thereto and may for example also include LED modules (e.g. for a retrofit lamp, but not restricted thereto).

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
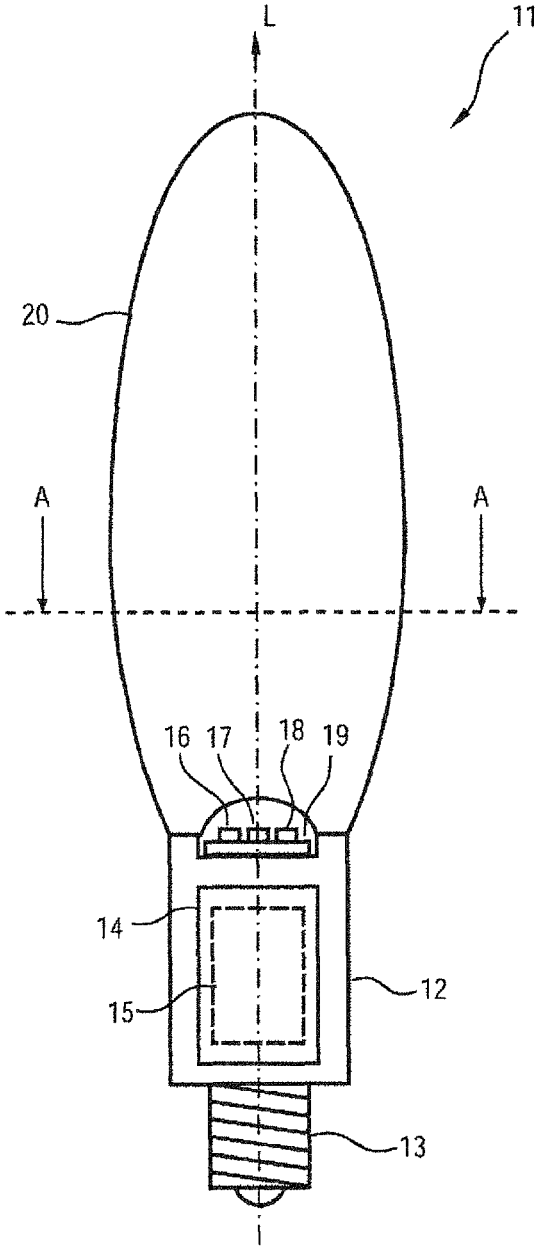
FIG. 1 shows an LED lighting device according to the present disclosure in the form of an incandescent lamp retrofit lamp as a sectional illustration in side view.

FIG. 1 shows an LED lighting device 11 in the form of an incandescent lamp retrofit lamp as a sectional illustration in side view. The LED lighting device 11 includes a heat sink 12, e.g. composed of aluminum, on which is situated at the rear side an electrical connection 13, e.g. an Edison base or a bipin base (e.g. of the GU type). The heat sink 12 has a driver cavity 14, in which a driver 15 is situated. The driver 15 is electrically connected to the electrical connection 13 and feeds a plurality of light-emitting diodes 16, 17, 18. The light-emitting diodes 16 to 18 are applied on a common ceramic substrate 19 bearing on the front side on the heat sink 12. On the front side, the heat sink 12 additionally carries an opaque envelope 20 arching over the light-emitting diodes 16 to 18.

Figure 2:
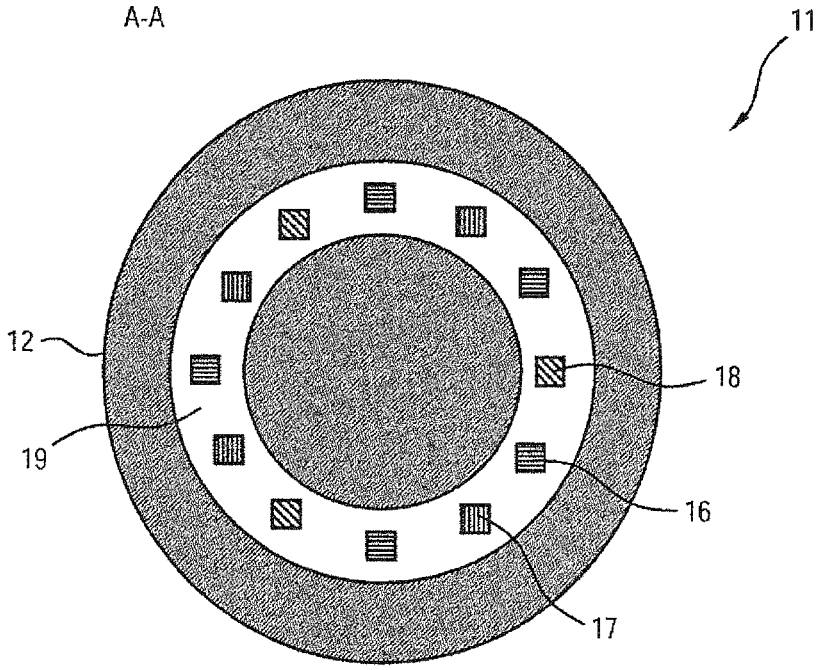
FIG. 2 shows the LED lighting device in a plan view of associated light-emitting diodes.

As shown in FIG. 2 in a section A-A through the envelope 20 that is perpendicular to a longitudinal axis L, the ceramic substrate 19 is embodied in a ring-shaped fashion, and the light-emitting diodes 16 to 18 are distributed thereon in a manner spaced apart uniformly in the circumferential direction.

The light-emitting diodes 16 to 18 include five mint-colored light-emitting diodes 16 which consist of a blue InGaN chip with a green-yellow phosphor. The mint-colored (mixed) light emitted by the light-emitting diodes 16 may also be designated as "EQ white". Furthermore, four amber-colored light-emitting diodes 17 in the form of InGaAlP chips and three yellow light-emitting diodes 18, likewise in the form of InGaAlP chips, are present. The five mint-colored light-emitting diodes 16 and the four amber-colored light-emitting diodes 17 form a "brilliant mix". At least the three yellow light-emitting diodes 18 belong to different wavelength groups.

When the lighting device 11 is switched on in a cold state (e.g. at room temperature of 25° C.), the five mint-colored light-emitting diodes 16 and the four amber-colored light-emitting diodes 17 generate a mixed light which is shifted into the red in comparison with a warm-white mixed light at a normal operating temperature of approximately 85° C. This shift of the color locus is undesirable, however, in particular since the color locus is at an appreciable distance from the Planckian locus and does not correspond to a color impression of a conventional incandescent lamp to be imitated. In order to improve the color impression at low operating temperatures and to draw the color locus in the direction of the Planckian locus, the light emitted by the yellow light-emitting diodes 18 is used. The opaque envelope supports homogenization of the mixed light passing through it.

As the operating temperature rises, the cumulative color locus of the mint-colored light-emitting diodes 16 and of the amber-colored light-emitting diodes 17 approaches its desired value in the vicinity of the Planckian locus. Their brightness decreases in the process. A brightness of the yellow light-emitting diodes 18 decreases to a particularly great extent, however, such that a proportion constituted by the yellow light in the total mixed light emitted by the LED lighting device 11 is negligibly low at normal operating temperature. Consequently, the temperature-dependent adaptation of the color locus may be achieved even without active control. In particular, the driver 15 may still be configured as a single-channel driver, which makes its construction particularly simple.

It is also possible to make the LED lighting device 11 dimmable. During dimming, the operating temperatures remain in a high range. In order nevertheless to reproduce the property of a conventional incandescent lamp that the color locus shifts from white-yellow at 100% luminous flux to yellow-orange at 10% luminous flux, the driver 15 may be configured such that it reduces (dims) an operating current of the mint-colored light-emitting diodes 16 and of the amber-colored light-emitting diodes 17, while the yellow light-emitting diode(s) is/are operated with an unchanged current. This may lead, for example, to a shift in the color locus from 2550 K to 2150 K. The reduction of the operating current may take place, for example, by a lowering of the current level and/or by a change in a duty ratio in PWM operation.

The driver 15 may also be configured such that it switches off the yellow light-emitting diodes 18 upon the exceeding of a temperature threshold value (e.g. of 75° C.) near the normal operating temperature (e.g. of 85° C.)

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

11 LED lighting device
12 heat sink
13 electrical connection
14 driver cavity
15 driver
16 mint-colored light-emitting diode
17 amber-colored light-emitting diode
18 yellow light-emitting diode
19 ceramic substrate
20 envelope
L longitudinal axis

The invention claimed is:

1. An LED lighting device, comprising:

a plurality of light-emitting diodes belonging to different wavelength groups, wherein the plurality of light-emitting diodes comprises one or a plurality of sets comprising in each case one mint-colored light-emitting diode, one amber-colored light-emitting diode and a plurality of yellow light-emitting diodes, wherein the yellow light-emitting diodes belong to different wavelength groups, wherein the LED lighting device is designed, at a relatively low temperature, to operate only the yellow light-emitting diode from the wavelength group with the highest dominant wavelength and, as the temperature rises, to switch in progressively the yellow light-emitting diodes from the wavelength groups with the lower dominant wavelengths.

2. The LED lighting device as claimed in claim 1, wherein the number of yellow light-emitting diodes corresponds at least approximately to a number of the mint-colored light-emitting diodes and amber-colored light-emitting diodes.

3. The LED lighting device as claimed in claim 1, wherein the number of yellow light-emitting diodes corresponds at least approximately to one quarter of the light-emitting diodes.

4. The LED lighting device as claimed in claim 3, wherein the number of mint-colored light-emitting diodes and the number of amber-colored light-emitting diodes at least approximately correspond to one another and of them at least approximately every sixth mint-colored light-emitting diode and every third amber-colored light-emitting diode is replaced by a yellow light-emitting diode.

5. The LED lighting device as claimed in claim 1, wherein the LED lighting device is dimmable by reduction of an operating current of the mint-colored light-emitting diodes and of the amber-colored light-emitting diodes.

6. The LED lighting device as claimed in claim 1, wherein the LED lighting device comprises at least one blue light-emitting diode and is designed to switch off the at least one blue light-emitting diode upon a temperature threshold value being reached, wherein the temperature threshold value lies below a typical operating temperature of the at least on blue light-emitting diode.

7. The LED lighting device as claimed in claim 1, wherein the LED lighting device is a retrofit lamp.

8. The LED lighting device as claimed in claim 1, wherein the at least one mint-colored light-emitting diode comprises an InGaN chip, the at least one amber-colored light-emitting diode comprises an InGaAlP chip, and the at least one yellow light-emitting diode comprises an InGaAlP chip.

9. The LED lighting device as claimed in claim 1, wherein all light-emitting diodes comprise LED chips of the same basic type.

10. The LED lighting device as claimed in claim 1, wherein the LED lighting device is or comprises a "chip-on-board" module.

11. The LED lighting device as claimed in claim 1, wherein the LED lighting device is an incandescent lamp or halogen lamp retrofit lamp.

12. The LED lighting device as claimed in claim 9, wherein the LED chips are INGaN chips.

13. An LED lighting device, comprising:

a plurality of light-emitting diodes belonging to different wavelength groups, wherein the plurality of light-emitting diodes comprise at least one mint-colored light-emitting diode, at least one amber-colored light-emitting diode and a plurality of yellow light-emitting diodes, wherein the yellow light-emitting diodes belong to different wavelength groups, wherein the LED lighting device is designed, at a relatively low operating temperature, to operate only the yellow light-emitting diode from the wavelength group with the highest dominant wavelength and, as the operating temperature rises, to switch in progressively the yellow light-emitting diodes from the wavelength groups with the lower dominant wavelengths.

14. The LED lighting device as claimed in claim 13, wherein the operating temperature is junction temperature.

15. An LED lighting device comprising:

a plurality of light-emitting diodes belonging to different wavelength groups, wherein the plurality of light-emitting diodes comprise at least one set, each set comprising at least one mint-colored light-emitting diode, at least one amber-colored light-emitting diode and a plurality of yellow light-emitting diodes, wherein the yellow light-emitting diodes belong to different wavelength groups, wherein the LED lighting device is designed, at a relatively low temperature, to operate only the yellow light-emitting diodes from those wavelength groups with the highest dominant wavelength and, as the temperature rises, to switch in progressively the yellow light-emitting diodes from the wavelength groups with those lower dominant wavelengths.

* * * * *